US008975549B1

(12) United States Patent
Ward

(10) Patent No.: US 8,975,549 B1
(45) Date of Patent: Mar. 10, 2015

(54) PORTABLE MAIL SORTING AND CONSOLODATING METHOD AND MACHINE

(71) Applicant: Gregory L. Ward, Bentonville, AR (US)

(72) Inventor: Gregory L. Ward, Bentonville, AR (US)

( * ) Notice: Subject to any disclaimer, the term of this patent is extended or adjusted under 35 U.S.C. 154(b) by 0 days.

(21) Appl. No.: 14/051,996

(22) Filed: Oct. 11, 2013

Related U.S. Application Data

(63) Continuation of application No. 12/462,546, filed on Aug. 5, 2009, now Pat. No. 8,669,486.

(51) Int. Cl.
*B07C 3/00* (2006.01)

(52) U.S. Cl.
CPC . *B07C 3/00* (2013.01); *Y10S 209/90* (2013.01)
USPC ..... 209/584; 209/900; 700/224

(58) Field of Classification Search
USPC ..... 209/3.3, 584, 900; 700/224; 382/101, 382/102
See application file for complete search history.

(56) References Cited

U.S. PATENT DOCUMENTS

| | | | | |
|---|---|---|---|---|
| 4,205,780 | A | 6/1980 | Burns et al. | 235/454 |
| 4,632,252 | A | 12/1986 | Haruki et al. | 209/546 |
| 4,985,842 | A | 1/1991 | Ward | 364/478 |
| 5,031,223 | A | 7/1991 | Rosenbaum et al. | 382/1 |
| 5,703,783 | A | 12/1997 | Allen et al. | 364/478.01 |
| 6,292,709 | B1 | 9/2001 | Uhl et al. | 700/226 |
| 6,819,777 | B2 | 11/2004 | Baker et al. | 382/101 |
| 6,829,369 | B2 | 12/2004 | Poulin et al. | 382/101 |
| 7,442,897 | B2 | 10/2008 | Avant et al. | 209/584 |
| 8,138,438 | B2 * | 3/2012 | Stemmle | 209/584 |
| 8,143,548 | B2 * | 3/2012 | Stemmle | 209/584 |
| 8,669,486 | B2 * | 3/2014 | Ward | 209/584 |
| 2003/0038065 | A1 * | 2/2003 | Pippin et al. | 209/584 |
| 2005/0025340 | A1 | 2/2005 | Hickman | 382/101 |
| 2007/0272601 | A1 * | 11/2007 | Cormack | 209/584 |
| 2008/0011653 | A1 * | 1/2008 | Stemmle | 209/584 |
| 2009/0159508 | A1 * | 6/2009 | Kostyniuk et al. | 209/584 |
| 2009/0230031 | A1 * | 9/2009 | Norris | 209/584 |
| 2014/0249665 | A1 * | 9/2014 | Stemmle | 700/215 |

* cited by examiner

*Primary Examiner* — Joseph C Rodriguez
(74) *Attorney, Agent, or Firm* — Keisling & Pieper PLC; David B. Pieper

(57) ABSTRACT

A device for sorting out individual address mail from a pre-sorted route order mail stack including a device with a mail receiving receptacle, a conveyor for transferring mail through the machine, a reader and control for reading the bar code and mail address, and a mail delivery receptacle. When mail is added to the mail receiving receptacle the machine conveys only the mail for one address to the mail delivery receptacle and then stops until the mail delivery receptacle is clear. The machine uses the mail bar code and displays the address to the mail carrier for confirmation of the matching addresses for all of the mail to be delivered.

20 Claims, 5 Drawing Sheets

PORTABLE MAIL SORTING AND CONSOLODATING METHOD AND MACHINE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in delivering machine pre-sorted route ready mail by separating a stack of mail into individual common address batches such that the postal worker is only presented with the mail for each separate delivery address at the time of delivery to that address and does not have to find the separation points between the various addresses in the stack.

2. Description of the Known Art

As will be appreciated by those skilled in the art, mail sorting devices are known in various forms. Currently D.P.S., also known as Distribution Point Sequence, mail is sorted by a bar-code which is provided by the mailer or applied by the postal system. The bar-code contains information about each address which enables the post office to use automated sorting machines to sequence the individual pieces of mail into route order for each delivery route. While this mail has been sorted by automated machines, when it gets to the delivery carrier, it is still presented in one large stack and then has to be manually sorted through and separated and examined by the carrier before delivery to each address. This process, when done manually, is known as "fingering" the mail. This invention is directed to providing a machine for this manual process. This is desirable because many carriers so abhor having to finger the pre-sorted mail while delivering their route in their vehicle that they resort to casing this mail in the office into their sorting cases. Casing the mail is when you bundle it into individual groups with rubber bands around each separate group. While this lessens the burden of having to sort through two different bundles of mail on the route, cased mail and pre-sorted mail, it wastes time for the carrier to re-sort mail which is already sorted by route order. Also, the delivery carriers who do take their pre-sorted D.P.S. mail to the street sometimes resort to fingering this mail as they drive, taking their attention away from the task at hand, driving safely. Having a machine machine do this preparation to ready the mail stack into individual address bundles for delivery to each address would add productivity and reduce the amount of time each carrier spent out on the route, which would require less running time per delivery, which would in turn reduce fuel consumption of their delivery vehicle.

SUMMARY OF THE INVENTION

The present invention is directed to an improved mail sorting machine and method for receiving a stack of presorted mail and separating that mail stack into individual batches for delivery to a single address and individually presenting each batch to a postal worker one at a time. In this manner, the present invention includes a machine and process for presenting consolidated groups or batches of mail for delivery to a common address from a pre-sorted or D.P.S. Distribution Point Sequence mail, or any other machine-readable and address-sorted mail, to a mail carrier for individual delivery to each of the common addresses.

The invention describes a portable machine that is used in the delivery carriers vehicle. The delivery carrier loads the machine with a stack of D.P.S. mail. The individual mail pieces are conveyed from the D.P.S. stack, through the machine. Inside the machine the individual piece of mail goes past a bar code reader and a scanner. The bar code reader and the scanner are operatively connected to a microprocessor. The microprocessor is also operatively connected to a video monitor which displays the images of the mail pieces addresses to the carrier for confirmation of correct delivery. The microprocessor uses the bar code to determine the number of mail pieces to be delivered to each address by comparing the bar codes as each mail piece is conveyed through the machine. All bar codes for a given address are the same so the microprocessor sends all of the mail pieces which have the same bar code through to the delivery receptacle for delivery by the carrier. When a different bar code than the previous bar code is conveyed across the bar code scanner, the conveying process stops until the carrier removes the mail pieces which all have the same bar code and the same address for delivery. At this time the machine automatically restarts the process.

Several objects and advantages of the present invention are: less physical handling of mail pieces by the delivery carrier, resulting in more efficiency and speedier delivery with less physical strain of the delivery carrier; more accurate delivery of mail pieces due to easier method of affirming mail addresses; less time used per delivery by delivery carrier resulting in savings in cost per delivery address; and less time used per delivery means delivery vehicle spends less time running per delivery, resulting in fuel savings. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
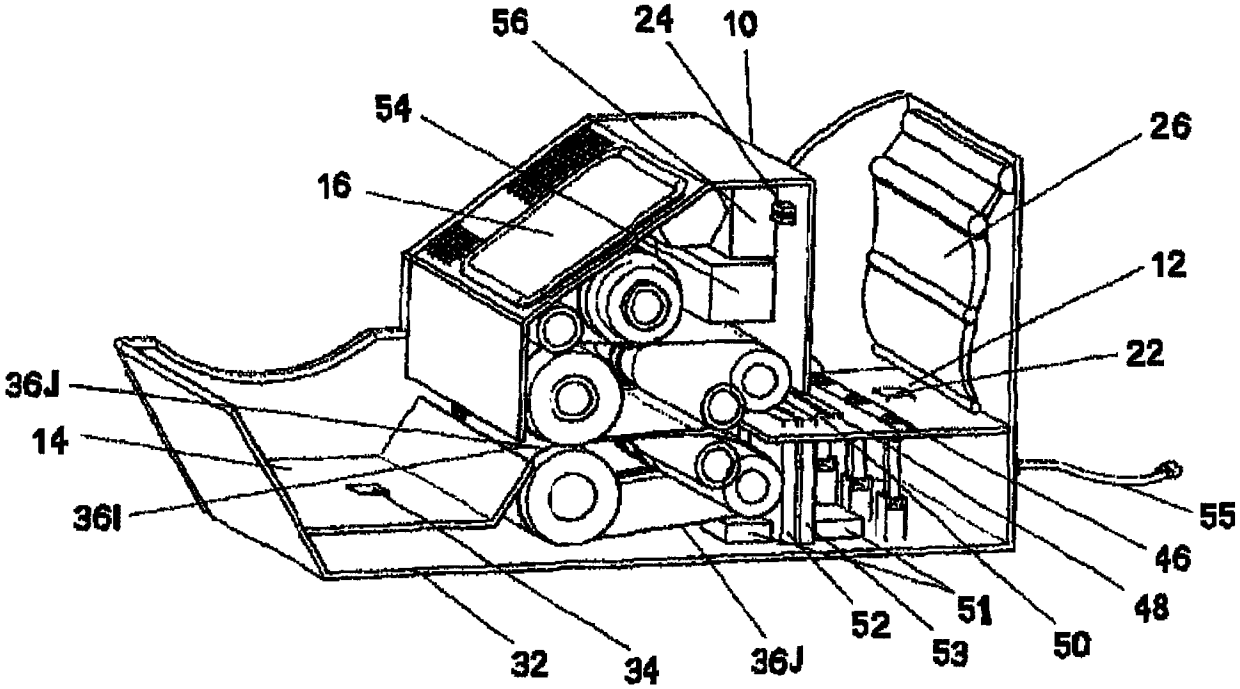
FIG. 1 is a perspective drawing of the machine.
Figure 2:
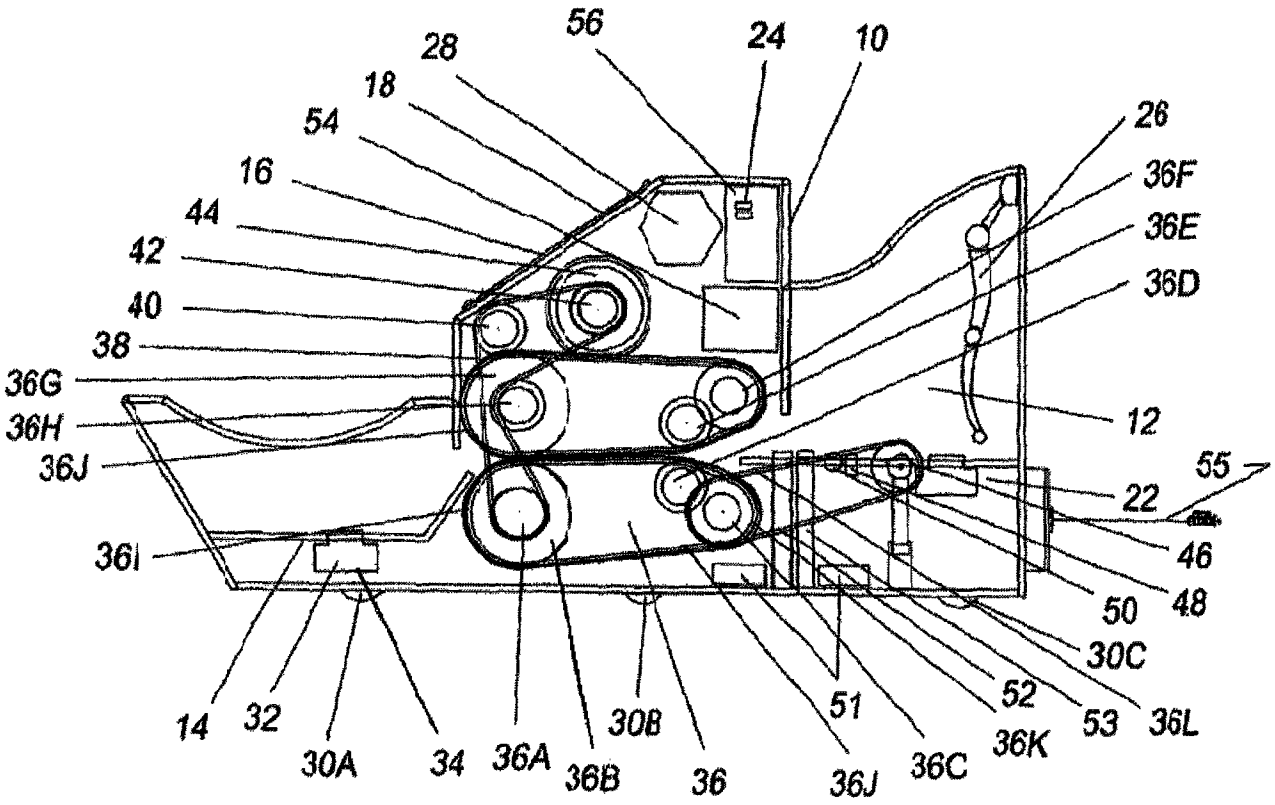
FIG. 2 is a right side view representative of the main inner parts.
Figure 3:
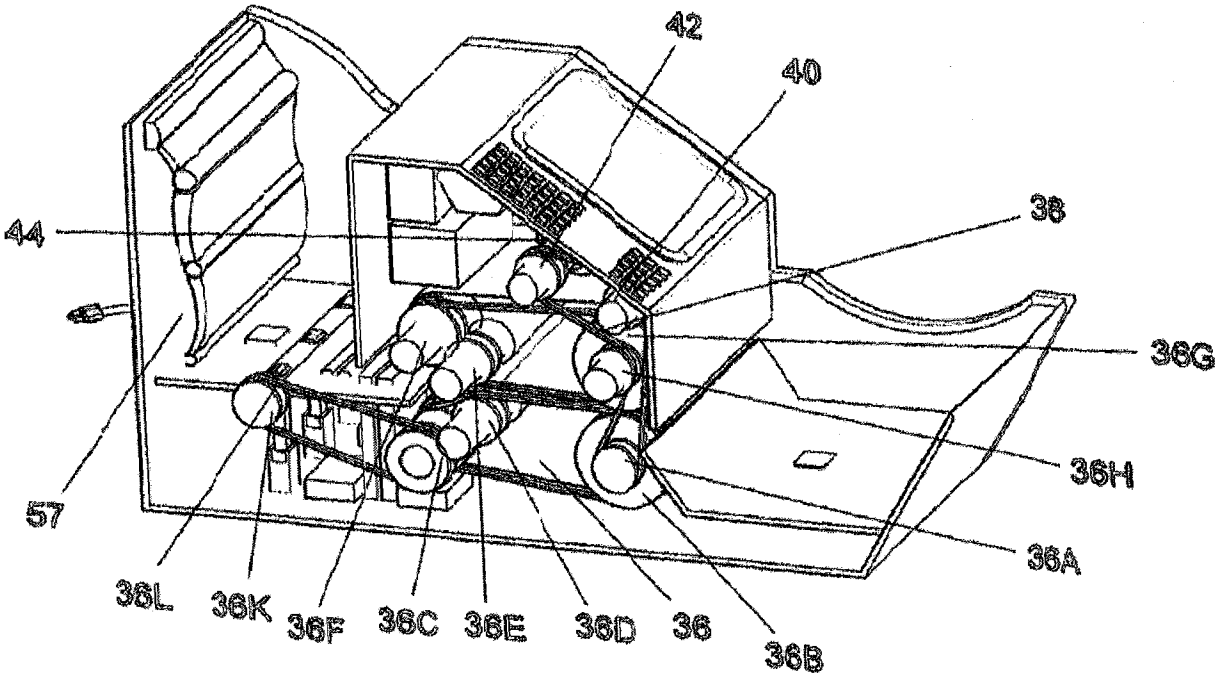
FIG. 3 is a left side perspective view of the main inner parts.

As shown in FIGS. 1 through 5 of the drawings, one exemplary embodiment of the present invention is generally shown as a separating machine 5. The separating machine 5 includes a base 32 with non-slip pads or strips 30*a*, 30*b*, and 30*c* mounted on the bottom 33. The separating machine contains chassis, not shown in drawings, to hold an outer protective and esthetic cover 10.

The esthetic cover 10 incorporates a mail receiving receptacle 12 with a downward pressure arm 26 and an optical sensor 22, a mail delivery receptacle 14, an L.C.D. or video or functional equivalent monitor 16, a console incorporating a keyboard function, switches, and function or warning lights 18, and an external computer input and download port 24. An externally mounted removable bar-code scanner with wireless blue-tooth type information relay system is attached for scanning accountable mail such as certified and registered mail. Removable or hinged access provisions and interior mounted cooling and dust exhausting fans, are also provided but are not shown in drawings. An external power cord for 12-volt vehicle accessory plug, not shown in drawings, can be mounted at the bottom of the receiving chute.

At the bottom of the mail receiving receptacle 12 is a solenoid activated pick roller 46 directing mail to a separator roller 50 and a separator pad 48. Inside the housing is mounted an image capturing scanner and a bar code reader or device which combines both functions 52. A mail conveying system is provided consisting of belts and rollers or the functional equivalent 36, 36*a*, 36*b*, 36*c*, 36*d*, 36*e*, 36*f*, 36*g*, 36*h*, 36*i*, 36*j*, 36*k* and 36*l* which are powered by a motor 44 and a drive mechanism 38 and controlled by a programmable computer or a microprocessor 56. An internal power source 54 is provided to power the internal devices. All of the additional wiring, relays, switches, transformers, fuses, circuit breakers, and attendant hardware for function, are not shown in drawings for clarity of the invention. The machine is preferably powered by a 12-volt vehicle accessory plug, not shown in drawings, and or by a self-contained rechargeable battery 54. The machine also has data access plugs for uploads and downloads 24 and a 110-volt AC cord for use in office environments, the AC cord is not shown in drawings.

The outer cover should be made of high-impact plastic and or metal or similar materials 10 and be hinged in strategic locations, not shown in drawings, to enable cleaning and maintenance or fixing jams. A small fan or fans would expel paper dust and other debris and cool the computer, these fans are not shown in drawings. A console is provided that is convenient to the carrier which would contain the power switch and a low- or no-mail warning light. A carrier initiated control is also provided to cause the conveyor to shuttle mail through the machine 18 to enable clearing jams. On-screen prompts are provided to warn the carrier of non-delivery addresses. A keyboard is contained in the console 18 and is used by the carrier to program prompts to be displayed on screen such as the name or names of the customer at each address, or a prompt to notify if a customers mail is on hold or is to be forwarded, and is thus not to be delivered. A route description function is incorporated, which could be downloaded from another computer or entered by the keyboard, which would display on-screen prompts and direction of travel to notify the carrier where next to turn or go straight from the last customers address to help new or substitute carriers more easily follow routes which are new to them. Alternatively, a G.P.S. function 54 could be used to do the same and help the post office track the carriers progress. Also some mailers are starting to want confirmation of date of delivery for their mailing. This information would be stored or downloaded to an online office computer.

The components and assembly are well known by those who are skilled in the art of the above mentioned invention. In addition the programming skills necessary for function of the computer, microprocessor, and G.P.S. units are well known by those skilled in the particular field. The machine may be made with fewer or more features or more or less complex and still serve the same functional method of separating the pre-sorted mail into deliverable groups or batches of mail to a common address for delivery to said common addresses. This provides a machine which consolidates the mail for each separate delivery address into a single stack for delivery to said address without the necessity to finger through and examine each individual piece before delivery to a single address. This is my current best mode of operation for this machine but it can be easily appreciated that the machine could serve its basic function with more or fewer parts or substitute parts such as no internal power source or no external scanner function and even no monitor or keyboard for basic function or a different mail conveying system or no input or download ports or function or no addition of a G.P.S., Global Positioning System, for the route travel information.

Operation

Figure 4:
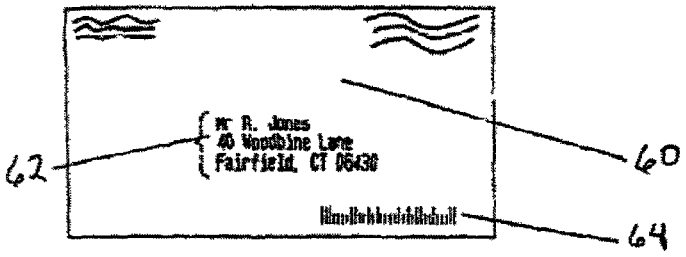
FIG. 4 is a representative view of the mail and features intended to be handled by the machine.
Figure 5:
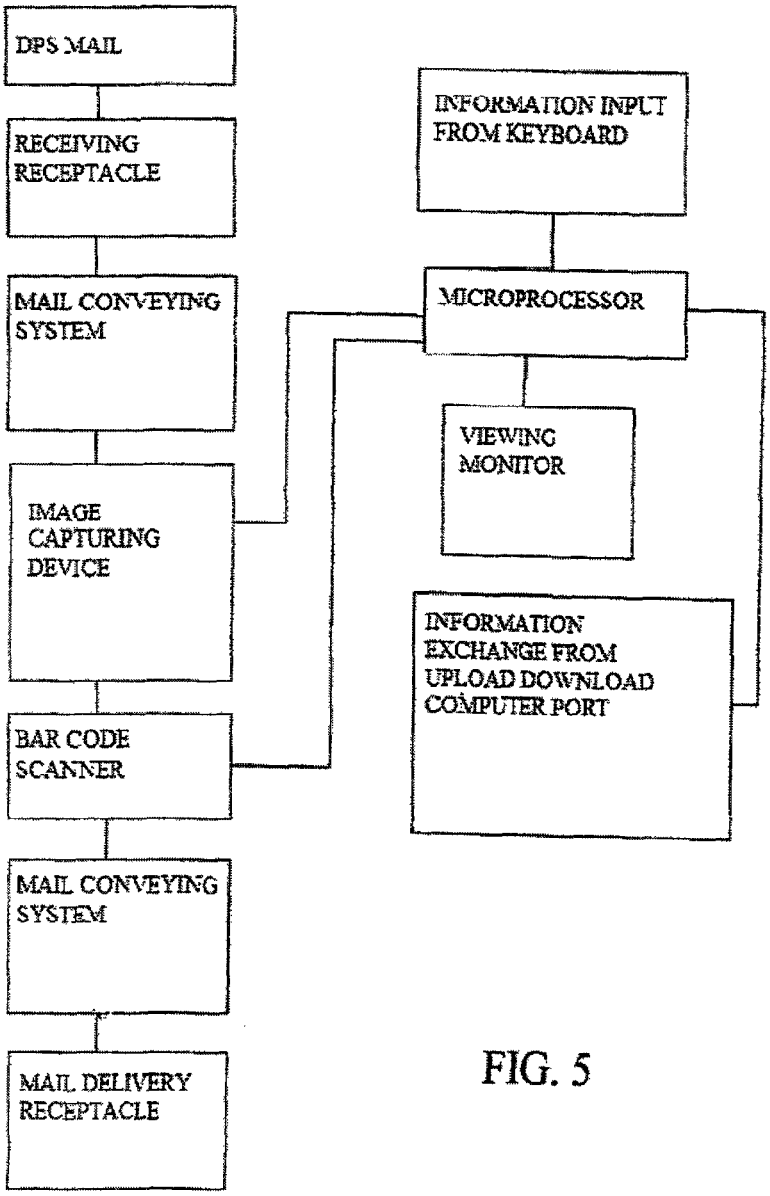
FIG. 5 is a flow chart showing the process.

In using my invention, the mail carrier would load D.P.S. pre-sorted mail typified by FIG. 4 into a receiving receptacle on the machine. The carrier would activate the machine via a console mounted switch. The machine is equipped with a downward tensioning device and an optical sensor or photo cell. The optical sensor or photo cell is used to activate a warning signal, a light, or on-screen prompt to notify the carrier when the receiving receptacle is empty or low. The mail loaded into the receiving receptacle conveys through the machine one piece at a time by means of a solenoid activated pick roller and belts and rollers powered by a motor. The motor is connected by a belt or belts or by gears. The mail conveys past a separator pad and a separator roller to insure separation of mail pieces. The mail passes over a wide angle optical character reader and bar code reader or a device which combines both functions to read the address bar code and transmit this information and the address image to a connected computer or microprocessor. The computer or microprocessor reads the address bar code and relays the address image to the monitor and determines the machine operation by the appropriate wiring and relays. The bar code is read and an image of the delivery address is taken and displayed on the front mounted video monitor or LCD screen. Route travel information appears on screen along with any carrier initiated prompts such as hold or forward mail. These prompts are previously entered by the keyboard or downloaded in the office. The piece of mail conveys onto a delivery receptacle convenient to the carrier. Then the next piece of mail is automatically conveyed past the reader where the same process is initiated. At this time the computer compares the new bar code with the previous bar code. If they are the same, indicating that both pieces belong to the same address, the new piece would automatically convey through to the receiving tray to join the first piece. The new address image would also be displayed on the monitor with the first image. This process would be repeated until a piece of mail came on which the bar code did not match the previous bar coded addresses. Then the conveying process would stop with all matching pieces displayed on the monitor and available to the carrier in the delivery tray. In the case that mail had inadvertently been turned backward or for whatever reason the bar code could not be read these pieces would convey through and the address would be displayed on the monitor or blank spaces would be shown on the monitor for the carrier to peruse and possibly manually sort. In the normal event that all bar codes are readable, the carrier would review the images on the monitor to ascertain that all pieces of mail were correct for delivery to that address. The carrier would remove any pieces which were not correct and deliver that batch to the address indicated. When mail pieces are removed from the delivery receptacle, the same process would automatically be repeated again, having been signaled by a sensor that the delivery receptacle is empty. The machine would also have a manual switch to operate the mail conveying system to help clear jams.

The steps for operation of the machine are as follows:

1. Remove machine from recharge and storage shelf.

2. This station may also optionally be used to upload and download information into and out of machine.

3. Install machine in convenient location in delivery vehicle. Plug in power cord.

4. Machine could optionally be self-contained and not require power from vehicle.

5. Power up machine and fill receiving receptacle with DPS mail.

6. Start machine and machine shuttles first piece of mail past image viewing and bar code reading device to delivery receptacle. Image of address is displayed on the monitor and bar code is read and temporarily stored in computer memory. The next piece of mail is automatically shuttled through the same process. The computer compares the new bar code with the bar code on the previous piece of mail. If the bar codes match, indicating that the addresses are the same, this piece of mail is also sent to the delivery tray. Then the next piece of mail is shuttled past the image viewer and bar code scanner, repeating the process until a bar code which does not match the previous bar codes is found which will indicate a new address. At this time the process is stopped and all processed mail pieces images are on monitor and all addresses which are the same being in the delivery receptacle and waiting pick up by the delivery carrier.

7. The machine may also optionally be equipped with a GPS feature or a route description to prompt carrier for direction of travel and which streets to follow. This would be especially helpful for new carriers and substitute carriers.

8. The machine may also be optionally be equipped with prompts to inform carrier when to refill the receiving receptacle or when not to deliver particular mail.

9. The delivery carrier checks the display monitor to affirm that all mail in the delivery receptacle is deliverable to the delivery address. The carrier removes the batch of mail from the delivery receptacle and if necessary, removes any non-deliverable mail before delivery to the customers mail receptacle.

10. The delivery carrier may also optionally enter information via keyboard to make notations for on-screen prompts to inform the carrier of non-deliverable mail, such as vacant houses, forwarding mail, holding mail, vicious dogs, etc.

11. The process described in section 6 is repeated by the machine. The carrier repeats his or her actions until all deliverable mail is delivered to customers.

12. The carrier arrives back at the post office and removes the machine and the non-deliverable mail from the delivery vehicle. The machine is returned to the storage shelf and plugged in to recharge. The non-deliverable mail is dealt with by the carrier on a per case basis.

13. In the case of intelligent mail bar codes for tracking, it would also be desirable to have a function of the machine store information read from the mail and download this information into a combination charging station/computer relay station and have this information forwarded by the download station.

CONCLUSION, RAMIFICATIONS, AND SCOPE

I have invented a method of presenting consolidated groups or batches of mail of a common address from pre-sorted or D.P.S. Distribution Point Sequence mail or any other machine-readable and address-sorted mail to a mail carrier for delivery to said common address. A machine which consolidates the consolidated single address mail for each separate delivery address into a single stack for delivery to said address without the necessity to finger through and examine each individual piece before delivery to a single address.

It may be observed that many embodiments of a machine which will consolidate mail into batches for the carrier to deliver may be manufactured. A partial list of examples follows. The following may be changed or deleted from machine and machine will still serve basic function.

1. No downward pressure arm. Gravity would work or a weight could be substituted.

2. No internal power supply. Machine could be made to function with only external power.

3. No 110 AC cord and transformer. It may not be deemed necessary to have machine operational for in-office casing operations.

4. No GPS or geographical route travel function.

5. No external wireless bar code scanner. Post office already has existing bar code scanners.

6. A different type of mail conveying system may be used and machine would still function the same.

7. No low or no mail sensor in the receiving tray.

8. No upload or download ports. It may be deemed unnecessary to upload or download information from microprocessor.

9. No keyboard for carrier input of information.

10. Although I consider the monitor to be necessary for the carrier to check for mistakes before delivery and not have to finger through the mail to do so, a basic functioning machine could be built with no monitor.

11. No cooling and dust exhausting fans.

12. No hinged access provisions.

13. No 12 volt vehicle power cord. Machine could be made to operate on only the rechargeable internal power source.

14. Thus the scope of the invention should be determined by the appended claims and their legal equivalents, rather than by the examples given.

Different embodiments of the invention may be utilized including the following:

A. A machine for presenting mail to delivery carrier for each delivery address from presorted mail pieces comprising.

a. a chassis means for affixment of components.

b. a cover means for protection of said components.

c. a monitor means for visually affirming addresses on said mail pieces.

d. a means for a receiving receptacle providing storage for the mail pieces to be processed.

e. a conveying means for moving the mail pieces through said machine.

f. a means of capturing images of said addresses of the mail pieces conveyed through said machine.

g. a means of reading a bar code on the mail pieces conveyed through the machine.

h. a means for a microprocessor operatively connected to said bar code means and to said conveying means and to said image capturing means and to said monitoring means to enable operation of the machine.

i. a power source means to enable operation of the machine.

j. a delivery receptacle means for removal of said processed mail by the carrier.

B. A machine for presenting mail to delivery carrier in accordance with the previous machine further including means for storing a database containing delivery information.

C. A machine for presenting mail to delivery carrier in accordance with the previous machine further including means of input of data from an external source.

D. A machine for presenting mail to delivery carrier in accordance with the previous machine labeled B further including means of displaying on the monitoring means customers names and addresses and delivery instructions and mail route line of travel directions.

E. A machine for presenting mail to delivery carrier in accordance with the previous machine labeled B further including a keyboard means for carrier input of information and data relevant to each delivery address for display on the monitor means.

F. A machine for presenting mail to delivery carrier in accordance with the previous machine labeled D further including a keyboard means for carrier input of information and data relevant to each delivery address with one or more of the following:

whereby a delivery carrier can more easily ascertain addresses of mail to be delivered whereby a delivery carrier can deliver mail with less physical handling of mail to be delivered.

whereby a delivery carrier can deliver mail more efficiently, more accurately, more safely, more comfortably, and use less fuel per delivery.

G. A machine for presenting mail to delivery carrier for each delivery address from presorted mail pieces including a. a chassis means for affixment of components;

b. a cover means for protection of said components;

c. a monitor means for visually affirming addresses on said mail pieces;

d. a means for a receiving receptacle providing storage for the mail pieces to be processed;

e. a conveying means for moving the mail pieces through said machine;

f. a device for reading bar code and capturing images of said addresses of the mail pieces conveyed through said machine;

g. a means for a microprocessor operatively connected to said bar code means and to said conveying means and to said image capturing means and to said monitoring means to enable operation of the machine;

h. a power source means to enable operation of the machine; and i. a delivery receptacle means for removal of said processed mail by the carrier.

H. A machine for presenting mail to delivery carrier in accordance with item G further including means for storing a database containing delivery information.

I. A machine for presenting mail to delivery carrier in accordance with item H with further comprising means of input of data from an external source.

J. A machine for presenting mail to delivery carrier in accordance with item I with further comprising means of displaying on the monitoring means customers names and addresses and delivery instructions and mail route line of travel directions.

K. A machine for presenting mail to delivery carrier in accordance with item H or I further including a keyboard means for carrier input of information and data relevant to each delivery address for display on the monitor means.

L. A machine for presenting mail to delivery carrier in accordance with item J with a keyboard means for carrier input of information and data relevant to each delivery address.

M. A process for presenting mail to a delivery carrier for each delivery address from presorted mail pieces including a. a first mail piece is conveyed past a bar code reading device to a delivery station a bar code is read and stored in memory.

b. a next mail piece is automatically conveyed past said bar code reading device said bar code is read and compared with said first mail piece bar code in said memory and stored if the bar codes match the first mail piece it is conveyed to said delivery station.

c. step b. is repeated until a bar code is conveyed which does not match the first mail piece it is stopped and not conveyed to the delivery station.

d. the mail piece or mail pieces in the delivery station all have the same bar code and are removed for delivery.

e. when mail is removed from the delivery station the above described process is repeated until all mail pieces are delivered.

Whereby a delivery carrier can more easily ascertain addresses of mail to be delivered.

Whereby a delivery carrier can deliver mail with less physical handling of mail to be delivered.

Whereby a delivery carrier can deliver mail more efficiently, more accurately, more safely, more comfortably, and use less fuel per delivery.

Not shown in drawings are power cords, transformers, cooling fans, all wiring, relays, switches, fuses, circuit breakers and attendant hardware for function as well as computer programs for microprocessor and G.P.S. units, as these items are well known by those skilled in the art.

Reference numerals used throughout the detailed description and the drawings correspond to the following elements:

5 Separating machine
10 Outer protective and esthetic cover
12 Mail receiving receptacle
14 Mail delivery receptacle
16 L.C.D. or video or functional equivalent monitor
18 Console incorporating a keyboard function, switches, and function lights
22 Optical sensor
24 External computer input and download port
26 Downward pressure arm
28 G.P.S. Global Positioning System
30 A, B, and C non-slip pad or strips
32 Base and frame
34 Optical sensor
36 Mail conveyors with floating belt
**36*a*** Pulley
**36*b*** Roller
**36*c*** Roller
**36*d*** Roller
**36*e*** Roller
**36*f*** Roller
**36*g*** Roller
**36*h*** Roller
**36*i*** Mail conveying belt or belts
**36*j*** Mail conveying belt or belts
**36*k*** Pulley
**36*l*** Pick roller drive belt

38 Main drive belt
40 Idler pulley
42 Drive pulley
44 Motor
46 Solenoid activated pick roller 48 Separator pad
50 Separator pad
52 Image capturing device reader and bar code reader or device which combines both functions
54 Internal power supply
56 Computer or microprocessor programmable
60 Typical letter
62 Typical address
64 Typical bar code From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

The invention claimed is:

1. A process for presenting a common address mail batch to a delivery carrier with each batch separated from a multiple address sequenced presorted mail pieces stack, each presorted mail piece including an address and a barcode, the process comprising:

providing a receiving receptacle, a single address delivery batch receptacle, and a conveying system connected between the receiving receptacle and the single address delivery batch receptacle, and an image capturing device positioned proximate to the conveying system;

receiving the multiple address sequenced presorted mail pieces stack in the receiving receptacle;

conveying a first piece of mail from the receiving receptacle past the image capturing device to the single address delivery batch receptacle;

capturing first bar code information from the first piece of mail;

conveying a second piece of mail from the receiving receptacle past the image capturing device;

capturing second bar code information from the first piece of mail;

comparing the first bar code information to the second bar code information; and controlling the conveying system by stopping subsequent sorting when the first bar code information does not match the second bar code information.

2. The process of claim 1, further comprising:

providing a delivery sensor in the single address delivery batch receptacle;

controlling the conveying system further comprising starting the conveying system when the delivery sensor indicates the single address delivery batch receptacle is empty.

3. The process of claim 1, further comprising:

providing a receiving sensor in the receiving receptacle;

controlling the conveying system further comprising stopping the conveying system when the receiving sensor indicates the single address delivery batch receptacle is empty.

4. The process of claim 1, further comprising:

providing a monitor;

capturing an address image; and displaying the address image on the monitor.

5. The process of claim 4, further comprising:

displaying a hold mail prompt on the monitor.

6. The process of claim 4, further comprising:

displaying a forward mail prompt on the monitor.

7. The process of claim 4, further comprising:

displaying a vacant house prompt on the monitor.

8. The process of claim 4, further comprising:

displaying a vicious dog prompt on the monitor.

9. The process of claim 4, further comprising:

displaying delivery instructions on the monitor.

10. The process of claim 4, further comprising:

displaying mail route line of travel directions on the monitor.

11. A process for presenting a common address mail batch to a delivery carrier with each batch separated from a multiple address sequenced presorted mail pieces stack, each presorted mail piece including an address and a barcode, the process comprising:

providing a receiving receptacle, a single address delivery batch receptacle, and a conveying system connected between the receiving receptacle and the single address delivery batch receptacle, and an image capturing device positioned proximate to the conveying system;

receiving the multiple address sequenced presorted mail pieces stack in the receiving receptacle;

conveying a first piece of mail from the receiving receptacle past the image capturing device to the single address delivery batch receptacle;

capturing first bar code information from the first piece of mail;

conveying a second piece of mail from the receiving receptacle past the image capturing device;

capturing second bar code information from the first piece of mail;

comparing the first bar code information to the second bar code information; and controlling the conveying system by conveying the second piece of mail to the single address delivery batch receptacle when the first bar code information matches the second bar code information.

12. The process of claim 11, further comprising:

providing a delivery sensor in the single address delivery batch receptacle;

controlling the conveying system further comprising starting the conveying system when the delivery sensor indicates the single address delivery batch receptacle is empty.

13. The process of claim 11, further comprising:
providing a receiving sensor in the receiving receptacle;
controlling the conveying system further comprising stopping the conveying system when the receiving sensor indicates the single address delivery batch receptacle is empty.

14. The process of claim 1, further comprising:
providing a monitor;
capturing an address image; and
displaying the address image on the monitor.

15. The process of claim 14, further comprising:
displaying a hold mail prompt on the monitor.

16. The process of claim 14, further comprising:
displaying a forward mail prompt on the monitor.

17. The process of claim 14, further comprising:
displaying a vacant house prompt on the monitor.

18. The process of claim 14, further comprising:
displaying a vicious dog prompt on the monitor.

19. The process of claim 14, further comprising:
displaying delivery instructions on the monitor.

20. The process of claim 14, further comprising:
displaying mail route line of travel directions on the monitor.

* * * * *